US005736716A

United States Patent [19]

Kim et al.

[11] Patent Number: 5,736,716

[45] Date of Patent: Apr. 7, 1998

[54] METHOD OF CONTROLLING THE OPERATION OF MICROWAVE OVEN HAVING A ROTARY, VERTICALLY RAISABLE FOOD TRAY

[75] Inventors: Kwang-Keun Kim; Seok-Weon Hong, both of Suwon, Rep. of Korea

[73] Assignee: Samsung Electronics Co., Ltd., Suwon, Rep. of Korea

[21] Appl. No.: 800,032

[22] Filed: Feb. 13, 1997

[30] Foreign Application Priority Data

Feb. 23, 1996 [KR] Rep. of Korea ..... 96-4363

[51] Int. Cl.[6] ..... H05B 6/68; H05B 6/78

[52] U.S. Cl. ..... 219/708; 219/753; 219/518; 99/325

[58] Field of Search ..... 219/708, 752, 219/753, 754, 755, 762, 763, 518, 705; 99/325, DIG. 14

[56] References Cited

U.S. PATENT DOCUMENTS

| | | | |
|---|---|---|---|
| 4,895,067 | 1/1990 | Ohji et al. | 219/708 |
| 5,345,068 | 9/1994 | Hatano et al. | 219/754 |

FOREIGN PATENT DOCUMENTS

| | | | |
|---|---|---|---|
| 3-17426 | 1/1991 | Japan | 219/708 |
| 4-369319 | 12/1992 | Japan | 219/708 |

*Primary Examiner*—Philip H. Leung

*Attorney, Agent, or Firm*—Burns, Doane, Swecker & Mathis, L.L.P.

[57] ABSTRACT

A microwave oven has a food tray which can be both rotated and elevated. A weight sensing unit senses the weight of the tray and any food thereon, for controlling the operation of a tray elevation/rotation mechanism. The tray is not elevated if the weight of the food is detected to be greater than a predetermined elevation weight, in order to prevent excessive pressure from being applied to the elevation/rotation mechanism and the weight sensing unit. If the weight of the food is detected to be greater than a maximum possible cooking weight, no cooking is performed, and an error signal is displayed.

4 Claims, 5 Drawing Sheets

METHOD OF CONTROLLING THE OPERATION OF MICROWAVE OVEN HAVING A ROTARY, VERTICALLY RAISABLE FOOD TRAY

FIELD OF THE INVENTION

The present invention generally relates to a method of controlling the operation of a microwave oven. More particularly, it relates to a method of controlling the operation of a microwave oven in which a tray on which food is loaded is capable of being rotated and elevated.

BACKGROUND OF THE INVENTION

Similar and related techniques are disclosed in the following applications.

Japanese Utility Model Publication (unexamined) No. 94-64013 (filed on Feb. 16, 1993) discloses a microwave oven including a heating chamber, a tray, a motor, and a rotating/elevating driving means. The rotating/elevating driving means, on which the tray is mounted, protrudes into the heating chamber, rotates and and/or elevates the tray by a forward operation of the motor. The rotating/elevating driving means discontinues the elevation of the tray at a predetermined height but still rotates the tray. If the motor rotates reversely at this point, the rotation of the rotating/elevating driving means is reversed to lower the tray to a predetermined position. The user can then remove and/or replace the food on the tray.

Japanese Patent Publication (unexamined) No. 90-83891 (filed on Mar. 30, 1990) discloses a microwave oven including a spin chuck table, a rotatable tray located on the spin chuck table, and a tray elevating device which raises the tray to a prescribed height. When the tray elevating device goes into action, the tray is disjoined from the spin chuck table and elevated. The tray is then rotated so that microwaves generated by a magnetron are uniformly delivered, even to the bottom of the tray.

Further, Japanese Patent Publication (unexamined) No. 87-087066 (filed on Apr. 10, 1987) discloses a device for preventing errors in zero-point control by indicating when the controller detects that food is not loaded on the tray in the heating chamber. In this device, the weight of the tray is previously stored in the controller to be used in measuring the weight of the food. If the tray and the installation plate are not placed along a shaft, the oscillator outputs a signal having a frequency that corresponds to 0 gram in the weight sensor to the microcontroller. Then, the microcontroller compares the stored reference weight with the output value from the oscillator and determines that the tray and the installation plate are not placed on the weight sensor, indicating an error on the display unit.

The description of a conventional microwave oven will now be given with reference to the accompanying drawings.

FIG. 5 shows a front cross-sectional view of a conventional microwave oven which comprises: a metallic cabinet 10; a cooking chamber 11; a magnetron (not shown) which radiates microwaves into the cooking chamber 11; a high-voltage transformer 13 which powers the magnetron; a heater 17 mounted on the upper portion of the cooking chamber 11 which performs a supplementary cooking function; a rotating tray 12, on which food is loaded, provided on the bottom of the cooking chamber 11 and which can be elevated therein; a shaft 31 having its upper end connected with the bottom of the tray 12 and its lower end extending below the cooking chamber 11; an elevation guide member 34 positioned under the shaft 31 to be driven to elevate the shaft 31; an elevation motor 33 that reciprocates the elevation guide member 34 laterally; a rotation motor 32 that rotates the shaft 31 by means of a gear **32*a* engaged between the shaft 31 and the rotation motor 32; and a weight sensing unit 35, provided under the elevation guide member 34, which measures the weight of food loaded on the tray 12**.

The operation of the above microwave oven will now be described as follows.

A microwave oven cooks food by applying approximately 2,450 MHz microwaves, which are generated by its magnetron, to food contained in its metallic case.

When microwaves are applied to food, each of the food's polar molecules aligns with respective opposite charges in the electric field generated by the microwaves. Since the polarity of the electric field is, however, alternated 2,450,000,000 times per second according to the frequency of the microwaves, heat is generated by collisions between the molecules resulting in the heating of the food.

The tray 12 on the inner bottom of the cooking chamber 11 rotates in a horizontal direction or moves up and down in the cooking chamber 11. The elevation guide member 34 has an inclined surface under the shaft 31 to elevate the shaft 31.

The elevation motor 33 reciprocates the elevation guide member 34 laterally and the rotation motor 32 rotates the shaft 31 by means of the gear **32*a* engaged between the shaft 31 and the motor 32**.

Thus, the microwave oven performs fast cooking of the food loaded on the tray 12 by the microwave energy and heat while the tray 12 rotates or moves up and down.

In the conventional microwave oven, if the weight of the food placed on the tray is too great, the shaft for rotating and elevating the tray, the elevation motor, the rotation motor, and the weight sensing unit could each be overloaded, thereby causing the microwave oven to malfunction or fail to operate.

SUMMARY OF THE INVENTION

Therefore, it is the object of the present invention to provide a method of controlling the operation of a microwave oven, in which a weight sensing unit detects the weight of food placed on the tray and determines whether or not the weight is greater than a predetermined weight so as to properly control the elevating and/or rotating operation of the tray, thereby preventing the malfunction of the oven due to the overload of the elevation and rotation means for a tray and on the weight sensing unit.

In order to achieve the above object, the present invention discloses a method of controlling the operation of a microwave oven having a cooking chamber for cooking food placed on a tray by microwave energy and heat, elevation means for elevating the tray, and rotation means for rotating the tray. The method comprises the steps of rotating the tray by turning on the rotation means when an operation initiation signal is received; if a signal of starting operation is input; detecting a weight of food placed on the tray; comparing the weight of the food with a predetermined elevation weight limit; elevating the tray up to a predetermined height by driving the elevation means if the weight of the food is less than the elevation weight limit; and turning off the elevation means if the weight of the food is greater than the elevation weight limit.

BRIEF DESCRIPTION OF THE DRAWINGS

For a more complete understanding of the present invention and the advantages thereof, the present invention will be now described in conjunction with the accompanying drawings of which.

DETAILED DESCRIPTION OF PREFERRED EMBODIMENTS

A preferred embodiment of the present invention will be described in detail with reference to the accompanying drawings.

Figure 1:
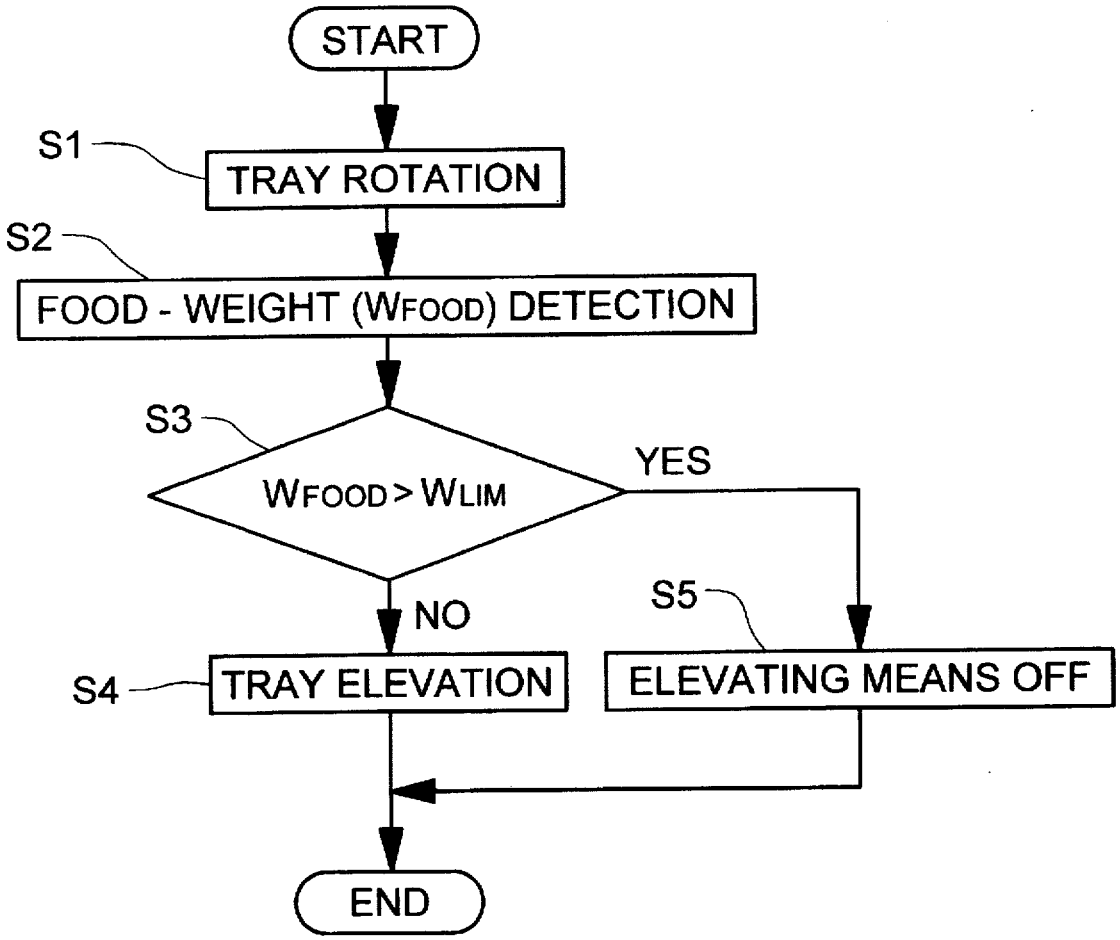
FIG. 1 is a flow chart showing a method of controlling the operation of a microwave oven according to the present invention.
Figure 2:
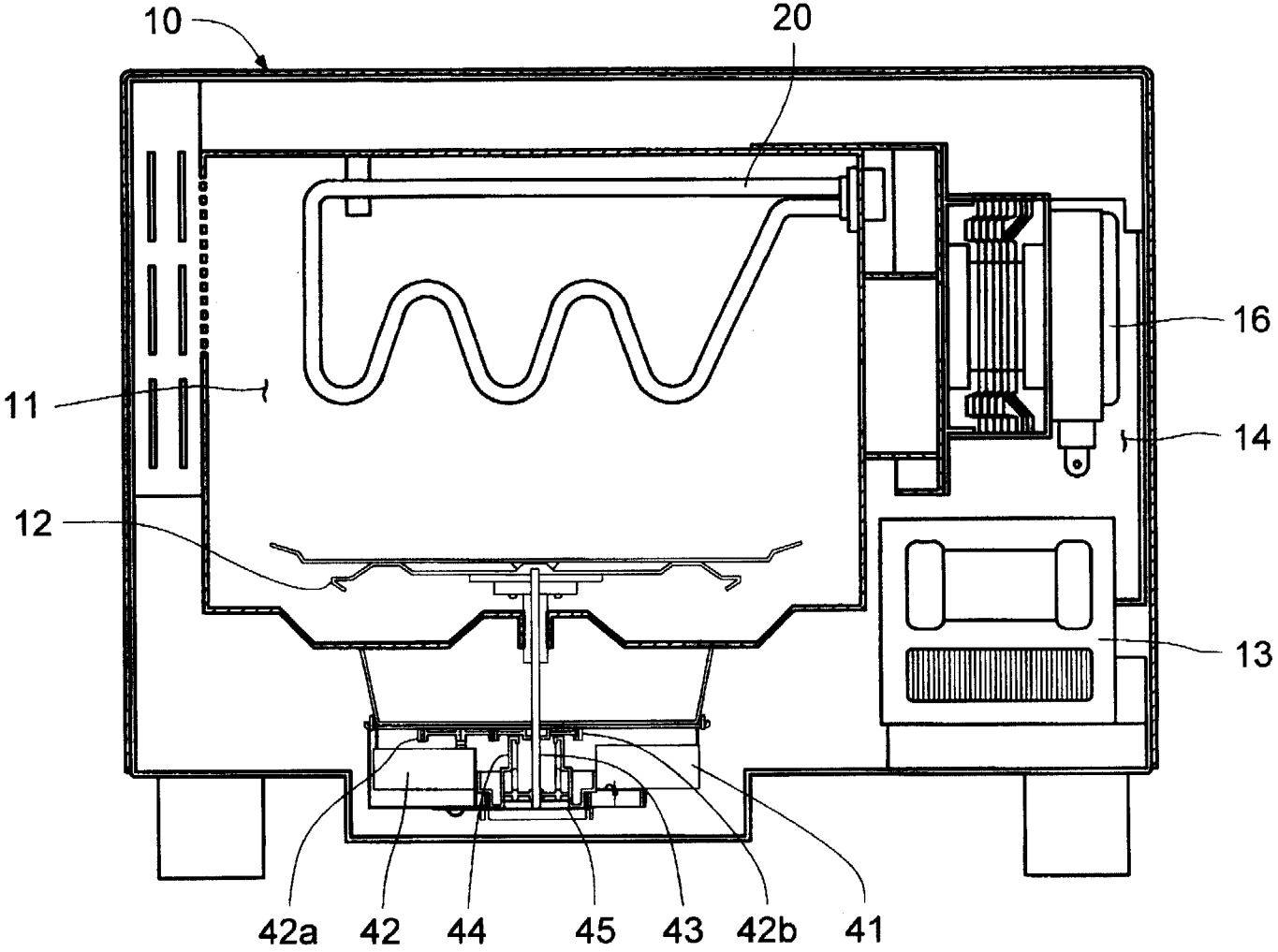
FIG. 2 shows a vertical cross-sectional view of a microwave oven according to the present invention.

As shown in FIG. 2, a microwave oven according to the present invention includes a cooking chamber 11; a magnetron 16 provided in an electric component compartment 14 for emitting microwaves into the cooking chamber 11; a high-voltage transformer 13 which powers the magnetron 16; a heater 20 mounted on the upper portion of the cooking chamber 11 which cooks food by radiant and convection heat; a rotating tray 12 provided on the bottom of the cooking chamber 11 which receives food and is designed to be elevated or lowered; a shaft 43 having its upper end connected to the bottom center of the tray 12 and its lower end extending below the cooking chamber 11; a rotation motor 42 which delivers torque to rotary gears 42*a*, 42*b* so as to rotate the shaft 43 and thus the tray 12; an elevation guide member 44 positioned under the shaft 43; an elevation motor 41 which drives the elevation guide member 44 so as to elevate the shaft 43; and a weight sensing unit 45 placed under the elevation guide member 44 which measures the weight of food placed on the tray 12 by sensing the pressure applied by the shaft 43 when the shaft 43 and the tray 12 are lowered to the their lowest position.

Figure 3:
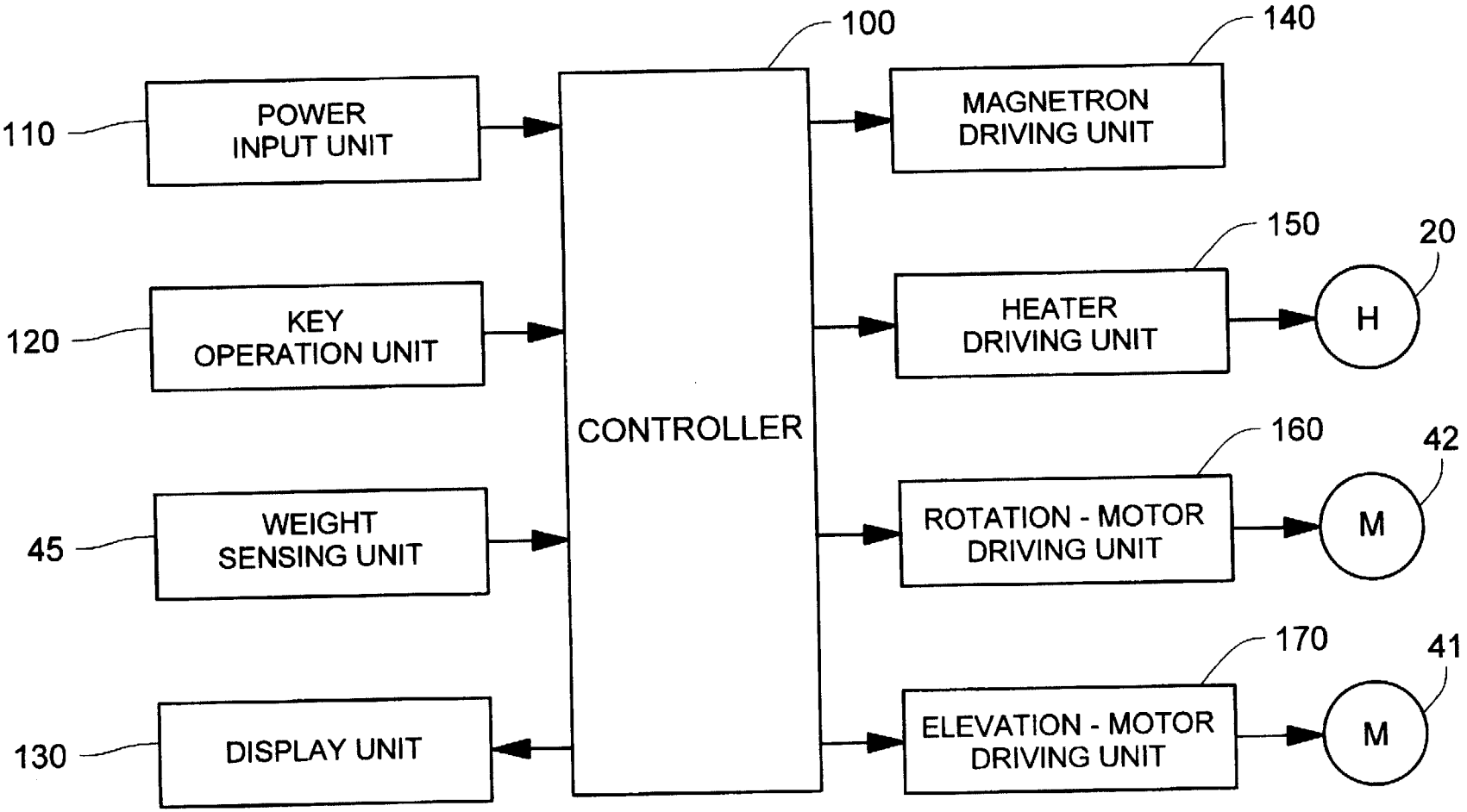
FIG. 3 shows a schematic diagram of a control system for a microwave oven according to the present invention.

The control system for a microwave oven according to the present invention is illustrated in FIG. 3.

It includes a controller 100 which controls the overall operation of the microwave oven from the start to the completion of cooking; a power input unit 110 which supplies power to the controller 100; a key operation unit 120 used to input a desired cooking mode and duration; a display unit 130 which displays the state of the oven and cooking conditions during operation; a heater driving unit 150 which controls the operation of the heater 20; a magnetron driving unit 140 which controls the operation of the magnetron 16; an elevation motor driving unit 170 which controls the operation of the elevation motor 41 that elevates the tray 12 under the control of the controller 100; a rotation motor driving unit 160 which controls the operation of the rotation motor 42 that rotates the tray 42; and a weight sensing unit 45 for detecting the weight of food on the tray 42.

Next, the method of controlling the operation of the microwave oven of the present invention will be described with reference to FIG. 4. The method comprises the steps of:

placing food on the tray 12 with power applied to the microwave oven and then selecting the desired cooking mode (S10);

determining if the operation has been started after the operation initiation signal has been inputted on the key input unit 120 (S12);

sending a control signal to the rotation motor driving unit 160 which drives the rotation motor 42, thereby rotating the tray 12 (S14);

detecting the weight of food $W_{FOOD}$ by a difference in the frequencies of the output signals from the weight sensing unit 45 before and after the food is placed on the tray 12 (S16);

comparing the weight of the food $W_{FOOD}$ detected in the step S16 with a predetermined elevation weight limit $W_{LIM}$ to determine whether $W_{FOOD}$ is greater than $W_{LIM}$ (S18);

comparing the weight of the food $W_{FOOD}$ with a predetermined maximum permissible cooking weight $W_{MAX}$ to determine whether $W_{FOOD}$ is greater than $W_{MAX}$, if the weight of the food $W_{FOOD}$ is greater than the weight limit $W_{LIM}$ (S20);

elevating the tray 12 to a proper height by calculating the height based on the selected cooking mode and the weight of the food $W_{FOOD}$ detected in the step S16 by means of a program stored in the controller 100, if the weight of the food $W_{FOOD}$ is less than the weight limit $W_{LIM}$ (S22);

displaying an error to notify a user of the occurrence of an error in order to prevent pressure over the permissible weight from being applied to the weight sensing unit 45, if the weight of the food $W_{FOOD}$ exceeds the maximum permissible weight $W_{MAX}$ (S24);

driving the magnetron 16 and the heater 20, but only rotating the tray, if the weight of the food $W_{FOOD}$ is greater than $W_{LIM}$ and less than the maximum permissible weight $W_{MAX}$ or after step S22 is completed (S26);

determining whether the requested cooking time has passed, and, if it has not, returning to the step S26 if the cooking time is not over (S28); and turning off the magnetron 16 and the heater 20 if the requested cooking time has passed (30).

Figure 4:
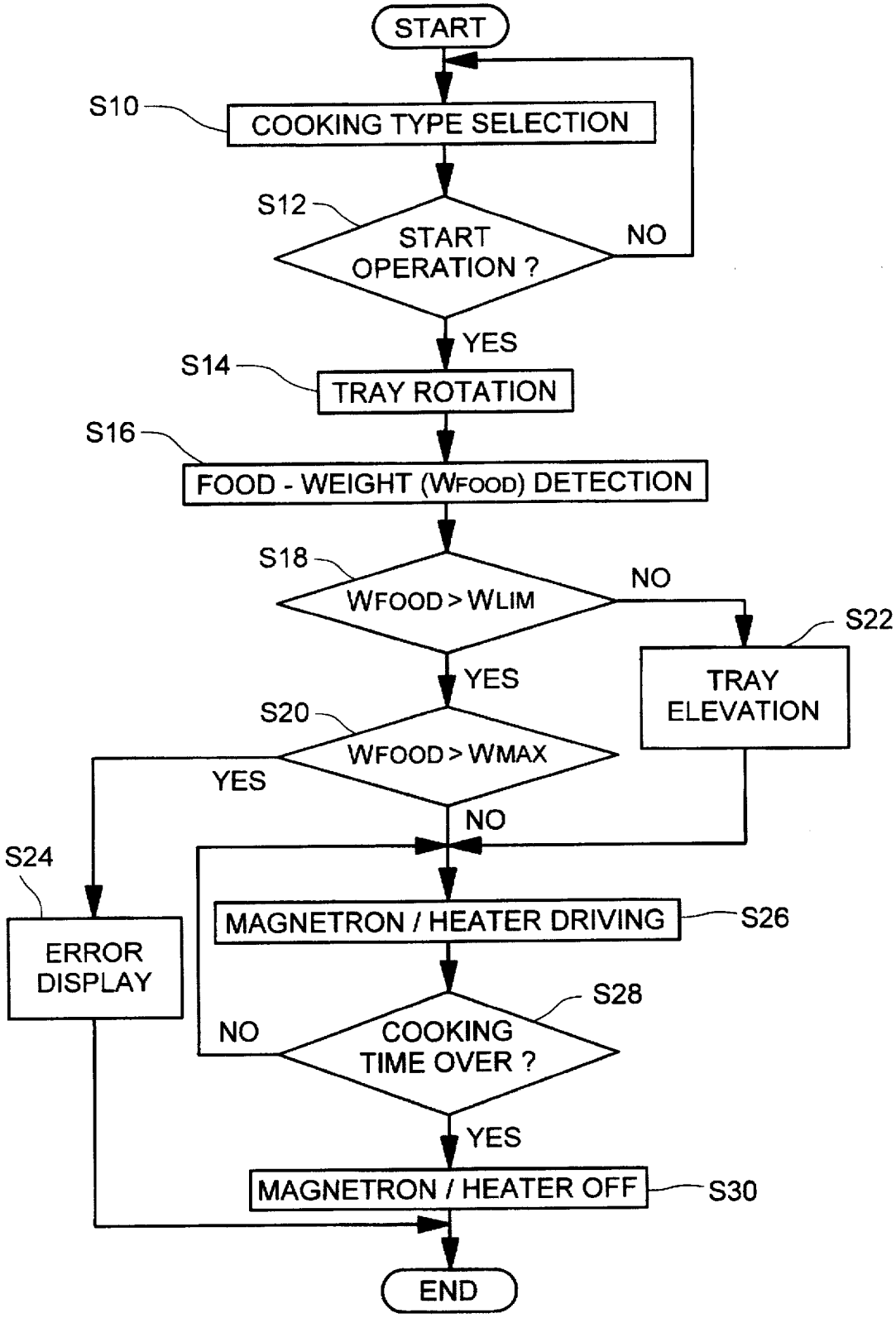
FIG. 4 is a flow chart showing a method of controlling the operation of a microwave oven according to the present invention.
Figure 5:
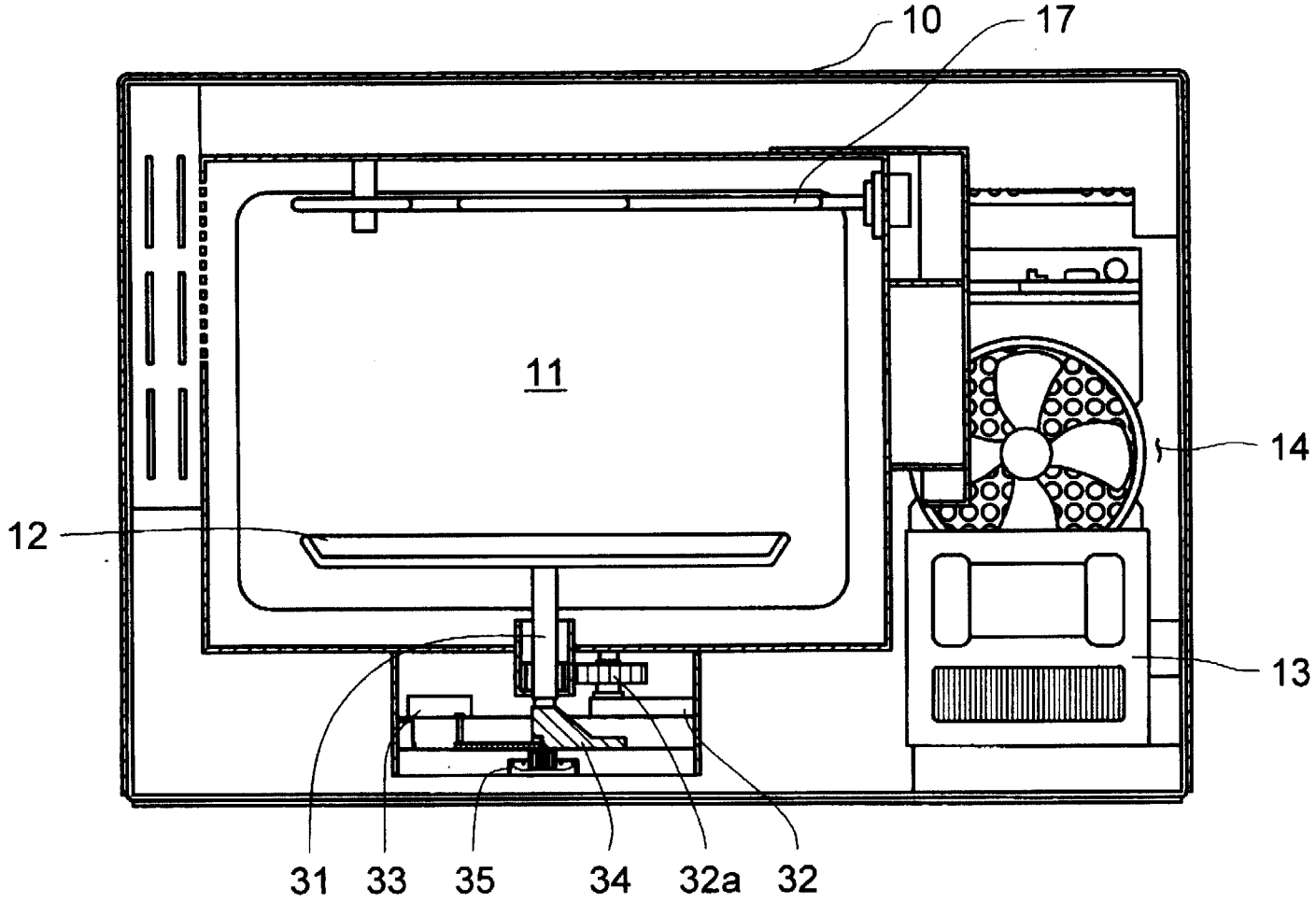
FIG.5 (PRIOR ART)
FIG. 5 is a vertical cross-sectional view of a convention microwave oven.

Referring to FIG. 4, the method of controlling the operation of a microwave oven according to the second embodiment of the present invention will be described in the following.

First, the user places food on the tray 12 with power applied to the microwave oven and then selects the desired cooking mode (S10).

The controller 100 starts the operating procedure when the operation initiation signal is input on the key input unit 120 (S12).

Then, the controller 100 sends a control signal to the rotation motor driving unit 160 which drives the rotation motor 42, thereby rotating the tray 12 (S14). Since the shaft 43 is situated in its lowered position, the pressure corresponding to the weight of food placed on the tray 12 is applied to the weight sensing unit 45 under the shaft 43.

Next, the controller 100 detects the weight of food $W_{FOOD}$ by the difference in the frequencies of the output signals from the weight sensing unit 45 before and after the food is placed on the tray 12 (S16).

Then, the controller 100 compares the weight of the food $W_{FOOD}$ detected in the step S16 with a predetermined elevation weight limit $W_{LIM}$ to determine whether $W_{FOOD}$ is greater than $W_{LIM}$ (S18). For example, the weight limit $W_{LIM}$ is set to approximately 1.5 kilograms if an automatic cooking, mode thawing cooking mode or warming mode has been selected.

If the weight of the food $W_{FOOD}$ is greater than the weight limit $W_{LIM}$, the controller 100 compares the weight of the food $W_{FOOD}$ with a predetermined maximum permissible cooking weight $W_{MAX}$, set greater than $W_{LIM}$ to determine whether $W_{FOOD}$ is greater than $W_{MAX}$ (e.g., 4 Kg) (S20).

If the weight of the food $W_{FOOD}$ is less than the weight limit $W_{LIM}$ in step S18, the controller 100 drives the elevation motor 41 to elevate the tray 12 to a height for optimum cooking calculated by a program stored in the controller 100 based on the selected cooking mode and the weight of the food $W_{FOOD}$ (S22).

If the weight of the food $W_{FOOD}$ exceeds the maximum permissible weight $W_{MAX}$ in the step S20, the controller 100 displays a message informing the user of the occurrence of an error, precluding possible damage to the oven by the food (S24). No cooking is then performed.

If the weight of the food $W_{FOOD}$ is greater than $W_{LIM}$ and less than the maximum permissible weight $W_{MAX}$ or after step S22 is completed, step S26 is proceeded to in which the controller 100 drives the magnetron 16 and the heater 20. The avoidance of elevating the tray when $W_{FOOD}$ is greater than $W_{LIM}$ but less than $W_{MAX}$ allows cooking to proceed but prevents the overload of the shaft 43 and the elevation motor 41.

Next, the controller 100 determines whether the set or calculated cooking time has passed, if it has not, returns to step S26 (S28).

If the cooking time has passed, the controller 100 turns off the magnetron 16 and the heater 20, completing the cooking process (S30).

Thus, according to the present invention, it is possible to prevent excessive pressure from being continuously applied to the elevation motor and the weight sensing unit and to thereby avoid the malfunction of the microwave oven.

What is claimed is:

1. A method of controlling the operation of a microwave oven utilizing a tray disposed in a cooking chamber, elevation means for elevating the tray, and rotation means for rotating the tray, the method comprising the steps of:

A) rotating said tray by actuating said rotation means when an operation initiating signal is received;

B) detecting the weight of food carried by said tray;

C) comparing the detected weight of the food with a predetermined elevation weight limit;

D) actuating said elevation means for elevating said tray to a predetermined height when the detected weight of the food is less than the elevation weight limit; and E) keeping said elevation means deactuated when the detected weight of the food is greater than the elevation weight limit.

2. The method of claim 1, further comprising the steps of:

comparing the detected weight of the food with a predetermined maximum permissible cooking weight, when the weight of the food detected in step B is greater than the elevation weight limit; and keeping said elevation means deactuated, deactuating said rotation means, and indicating the occurrence of an error, when the weight of the food detected in step B is greater than the maximum permissible cooking weight.

3. The method of claim 2, including the step of setting said maximum permissible elevation weight to be greater than said cooking weight limit.

4. The method of claim 2, wherein step E includes performing a cooking process without elevating the tray, when the weight of the food detected in step B is between the elevation weight limit and the maximum permissible cooking weight.

* * * * *